US006030098A

United States Patent [19]

Wang

[11] Patent Number: 6,030,098

[45] Date of Patent: Feb. 29, 2000

[54] COMBINED MODULAR TABLE LAMP AND CLOCK ASSEMBLY

[76] Inventor: I-Hwa Wang, No. 16, Kuo-Tai Lane, Sec. 2, Chang-Ping Rd., Pei Tun Dist., Taichung, Taiwan

[21] Appl. No.: 09/137,013

[22] Filed: Aug. 20, 1998

[51] Int. Cl.[7] ..... F21V 33/00

[52] U.S. Cl. ..... 362/253; 362/35; 362/234; 368/10

[58] Field of Search ..... 362/23, 351, 360, 362/410, 412, 806; 368/10, 256; 248/346.03, 165

[56] References Cited

U.S. PATENT DOCUMENTS

| | | | |
|---|---|---|---|
| 4,285,028 | 8/1981 | Sudin et al. | 362/35 |
| 5,926,440 | 7/1999 | Chien | 368/10 |

*Primary Examiner*—Sandra O'Shea
*Assistant Examiner*—Anabel Ton
*Attorney, Agent, or Firm*—Townsend and Townsend and Crew LLP

[57] ABSTRACT

A combined modular table lamp and clock assembly includes a base adapted to be placed on a table top, a lamp unit, and a clock unit. The lamp unit includes a stand, a lamp device and a shade. The stand has a bottom section mounted removably on a top side of the base, a top section formed with a lamp base receiving groove, and a back side formed with a wire receiving groove. The lamp device includes a lamp base mounted removably in the lamp base receiving groove, a lamp bulb, an electrical plug, and an electrical wire which interconnects the lamp base and the electrical plug, and which is retained in the wire receiving groove. The shade is mounted removably on the top section of the stand to surround the lamp bulb. The clock unit includes a clock panel having a bottom end mounted removably on the top side of the base, and a front side which serves as a clock face and which is formed with an opening, and a clock hand mechanism having a housing retained in the opening. The clock hand mechanism cooperates with the clock face to indicate time.

9 Claims, 5 Drawing Sheets

COMBINED MODULAR TABLE LAMP AND CLOCK ASSEMBLY

BACKGROUND OF THE INVENTION

1. Field of the Invention

This invention relates to a combined modular table lamp and clock assembly which has a changeable appearance and which is easy to manufacture and assemble.

2. Description of the Related Art

A conventional lamp, such as a table lamp, has an appearance which is determined generally by the shapes of the stand and the lamp shade thereof. A conventional table clock or alarm clock has an appearance which is determined generally by the shapes of the clock panel and the housing of the clock hand mechanism. Accordingly, each of the conventional lamp and clock has a fixed appearance that cannot be changed as desired.

SUMMARY OF THE INVENTION

The object of the present invention is to provide a combined modular table lamp and clock assembly which has an appearance that is changeable, such as in the color and/or the shape thereof, by combining different modular elements so that a diverse range of choices is available to the consumer.

Accordingly, the combined modular table lamp and clock assembly of the present invention includes a base, a lamp unit, and a clock unit. The base has a top side and a bottom side which is adapted to be placed on a table top. The lamp unit includes a stand, a lamp device and a shade. The stand has a bottom section mounted removably on the top side of the base, a top section formed with a lamp base receiving groove, and a back side that extends between the top and bottom sections and that is formed with a first wire receiving groove. The lamp device includes a lamp base mounted removably in the lamp base receiving groove, a lamp bulb mounted on the lamp base, an electrical plug adapted for electrical connection with an electrical outlet, and an electrical wire having a first end connected electrically to the lamp base, and an opposite second end connected electrically to the electrical plug. The electrical wire is retained in the first wire receiving groove that is formed in the back side of the stand. The shade is mounted removably on the top section of the stand to surround the lamp bulb of the lamp device. The clock unit includes a clock panel having a bottom end mounted removably on the top side of the base, and a front side which serves as a clock face and which is formed with an opening, and a clock hand mechanism having a housing retained in the opening. The clock hand mechanism cooperates with the clock face to indicate time.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
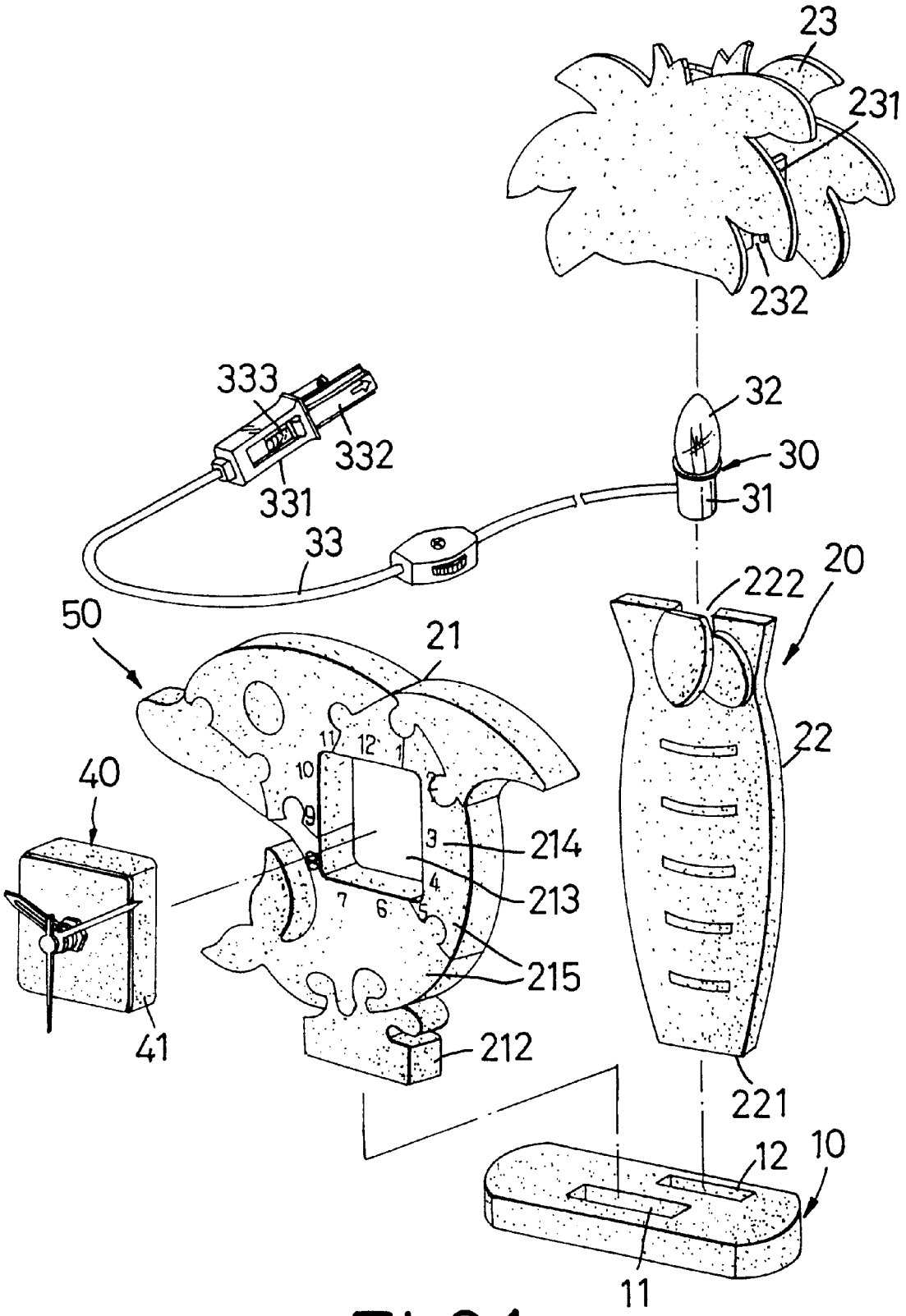
FIG. 1 is an exploded perspective view of a preferred embodiment of a combined modular table lamp and clock assembly according to this invention.
Figure 2:
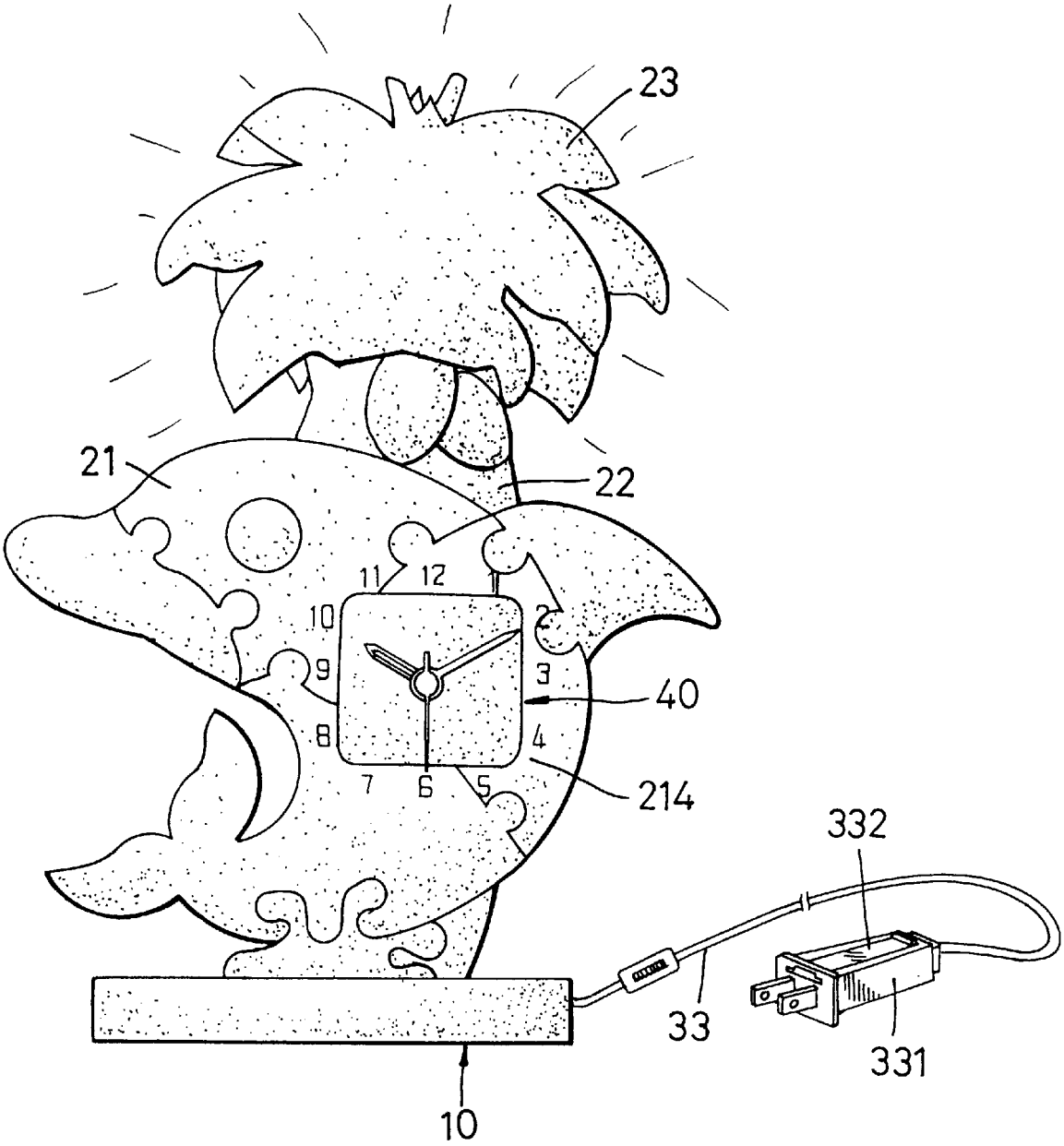
FIG. 2 is an elevation view of the preferred embodiment, viewed from a front side thereof.

Referring to FIGS. 1 and 2, the preferred embodiment of the combined modular table lamp and clock assembly of the present invention is shown to include a base 10, a lamp unit 20, and a clock unit 50.

The base 10 is formed from a resilient foam material, preferably a flame retardant foam material, such as ethyl vinyl acetate (EVA). The base 10 has a top side formed with a stand engaging groove 12 and a clock panel engaging groove 11 in front of the stand engaging groove 12, and a bottom side adapted to be placed on a table top. The stand engaging groove 12 extends through the base 10 to the bottom side.

The lamp unit 20 includes a stand 22, a lamp device 30, and a shade 23. The stand 22 is also formed from a foam material, preferably a flame retarding foam material, such as EVA, and has an appearance in the form of the trunk of a coconut tree. The stand 22 has a bottom section 221 inserted into the stand engaging groove 12 to engage removably the latter, a top section formed with a lamp base receiving groove 222, and a back side which extends between the top and bottom sections and which is formed with a first wire receiving groove 223 (see FIG. 3).

The lamp device 30 includes a lamp base 31 mounted removably in the lamp base receiving groove 222 of the stand 22, a lamp bulb 32 mounted on the lamp base 31, an electrical plug 331, and an electrical wire 33 having a first end connected electrically to the lamp base 31, and a second end connected electrically to the electrical plug 331. The electrical plug 331, which is adapted for electrical connection with an electrical outlet, has a fuse 333 received in a cavity thereof, and is provided with a cap 332 for access to the cavity to permit replacement of the fuse 333.

Figure 4:
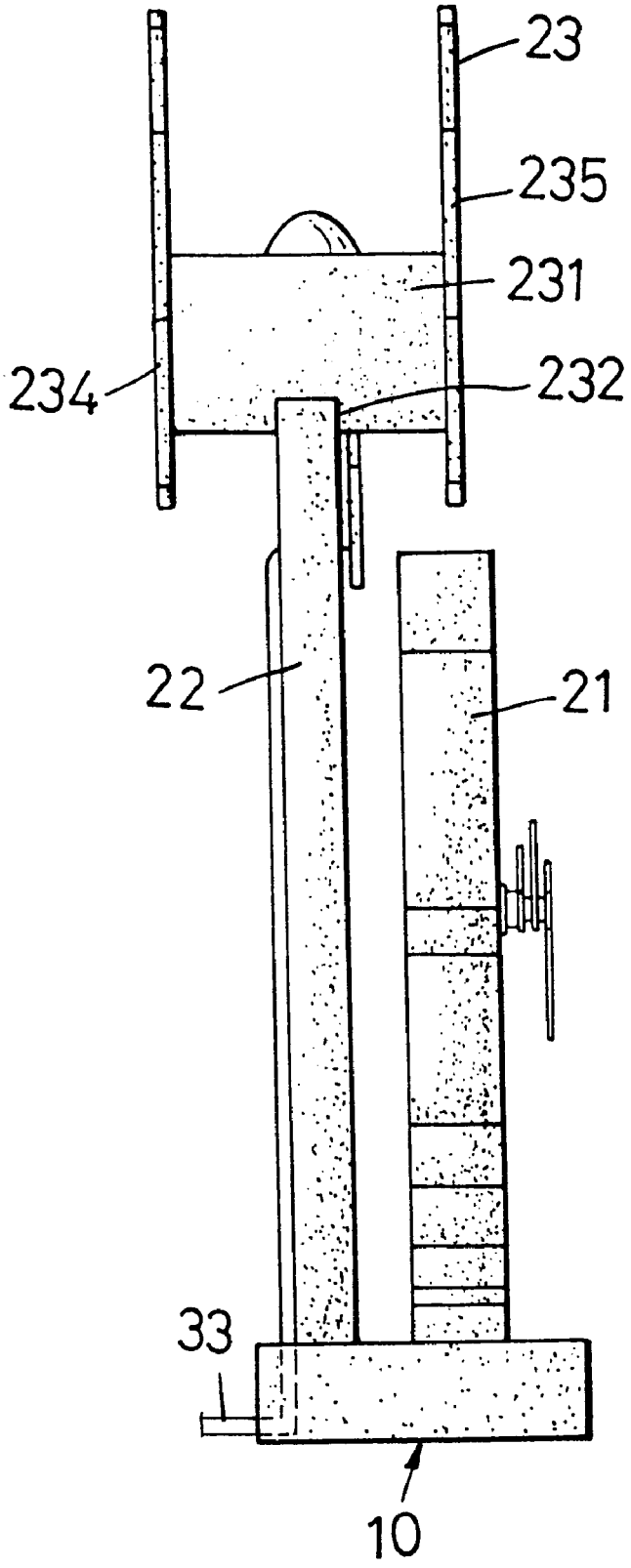
FIG. 4 is a side view of the preferred embodiment.
Figure 5:
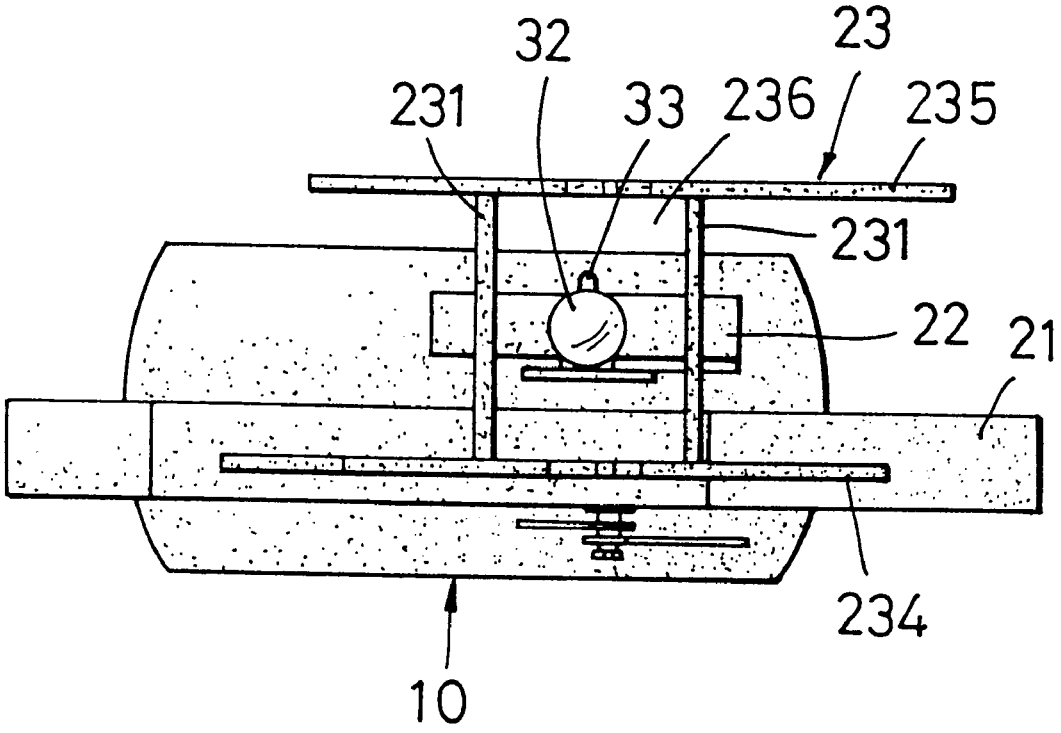
FIG. 5 is a top view of the preferred embodiment.

The shade 23 is also formed from a foam material, preferably a flame retardant foam material, such as EVA, and has an appearance in the form of the top of a coconut tree. The shade 23 is mounted removably on the top section of the stand 22 to surround the lamp bulb 32 of the lamp device 30. Referring to FIGS. 1, 4 and 5, the shade 23 has parallel front and rear shading walls 234, 235, and two bridging walls 231 transverse to the front and rear shading walls 234, 235. The front and rear shading walls 234, 235 and the bridging walls 231 cooperatively confine a space 236 for extension of the lamp bulb 32 thereinto. As the lamp bulb 32 is not in contact with inner surfaces of the front and rear shading walls 234 , 235 and t he bridging walls 231, heat transmission between the lamp bulb 32 and the shade 23 can be reduced. Each of the bridging walls 231 has a bottom edge formed with a mounting groove 232 for engaging the t op section of the stand 22. Thus, the front and rear shading walls 234, 235 straddle the opposite front and rear sides of the stand 22. As shown in FIG. 4, in the present embodiment, the bottom edges of the bridging walls 231 are raised relative to bottom edges of the front and rear shading walls 234, 235 so as to achieve an enhanced shading effect.

Figure 3:
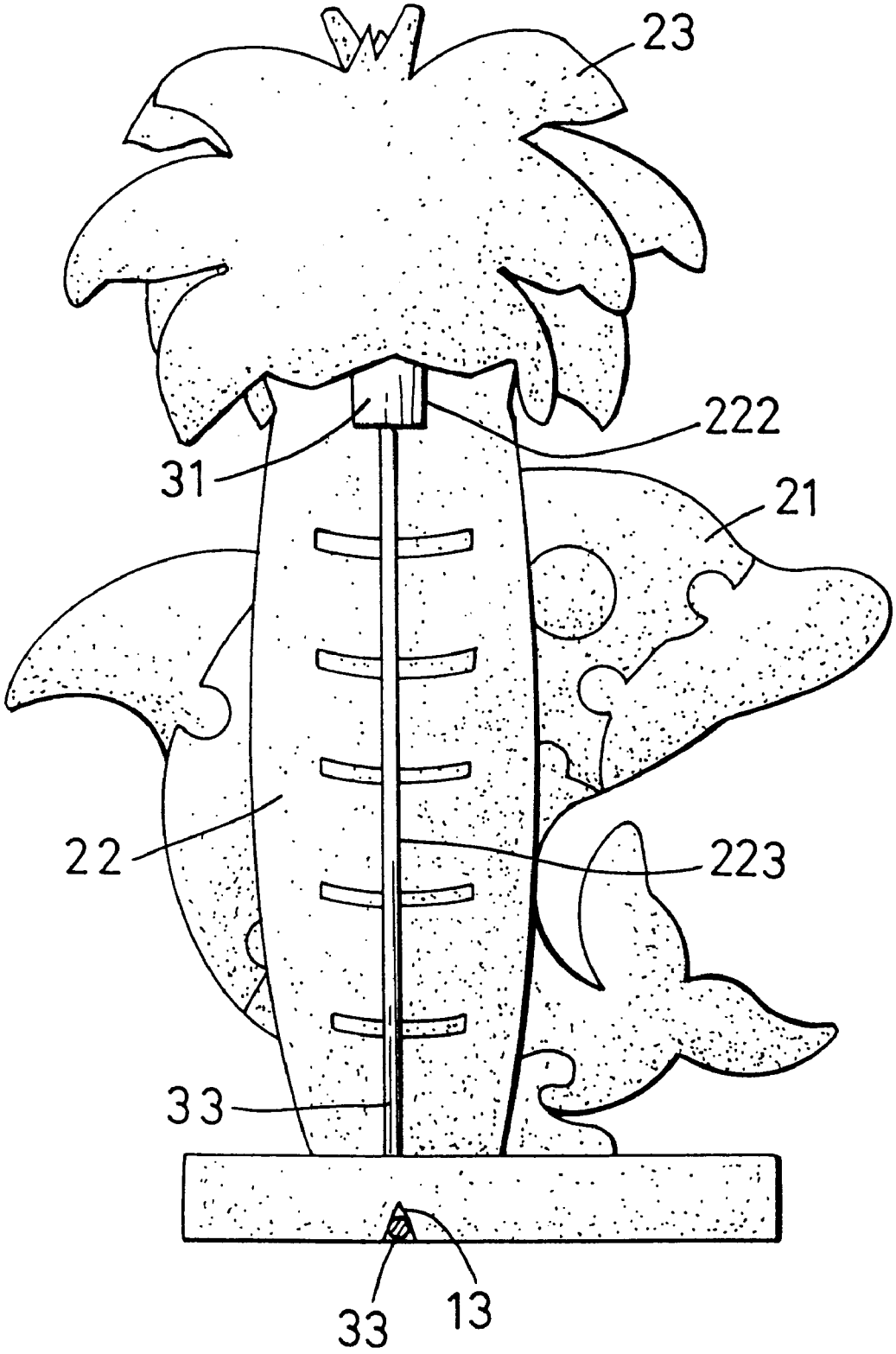
FIG. 3 is an elevation view of the preferred embodiment, viewed from a rear side thereof.

As shown in FIGS. 3 and 4, the electrical wire 33 is retained in the first wire receiving groove 223 formed in the back side of the stand 22, and extends through the stand engaging groove 12 (see FIG. 1) to the bottom side of the base 10. The bottom side of the base 10 is formed with a second wire receiving groove 13 which extends between the stand engaging groove 12 and a periphery of the base 10 for receiving a portion of the electrical wire 33 such that the base 10 can be placed stably on the table top. In addition, an orderly appearance results since the electrical wire 33 is retained fittingly in the first and second wire receiving grooves 223, 13, and is not visible from the front side of the table lamp and clock assembly.

Referring again to FIGS. 1 and 2, the clock unit 50 includes a clock panel 21 and a clock hand mechanism 40.

The clock panel 21 is also formed from a foam material, preferably a flame retardant foam material, such as EVA. The clock panel 21 includes a plurality of interlocking panel pieces 215, and has an appearance in the form of a dolphin. The clock panel 21 has a bottom end 212 which is inserted into and which engages releasably the clock panel engaging groove 11 formed in the base 10, and a front side which serves as a clock face 214 and which is formed with a rectangular opening 213. The clock hand mechanism 40 has a housing 41 retained in the opening 213. The clock hand mechanism 40 cooperates with the clock face 214 to indicate time.

Since the shade 23, the stand 22, the base 10, the lamp device 30, the clock panel 21, and the clock housing 41 are mounted releasably to one another, assembly of the preferred embodiment is easy to conduct. Moreover, the lamp unit 20 can be used with a clock unit having an appearance other than the form of a dolphin. Likewise, the clock unit 50 can be used with a lamp unit having an appearance other than the form of a coconut tree. In addition, the colors of the shade 23, the stand 22, the base 10, the interlocking panel pieces 215 of the clock panel 21, and the housing 41 of the clock hand mechanism 40 can be selected to suit the color of the light generated by the lamp bulb 32. In this manner, a multiplicity of products that differ in color and appearance can be produced to provide a diverse range of choices to fit the requirement of a particular consumer.

With this invention thus explained, it is apparent that numerous modifications and variations can be made without departing from the scope and spirit of this invention. It is therefore intended that this invention be limited only as indicated in the appended claims.

I claim:

1. A combined modular table lamp and clock assembly, comprising:

a base having a top side and a bottom side which is adapted to be placed on a table top;

a lamp unit including:

a stand having a bottom section mounted removably on said top side of said base, a top section formed with a lamp base receiving groove, and a back side that extends between said top and bottom sections and that is formed with a first wire receiving groove;

a lamp device including a lamp base mounted removably in said lamp base receiving groove, a lamp bulb mounted on said lamp base, an electrical plug adapted for electrical connection with an electrical outlet, and an electrical wire having a first end connected electrically to said lamp base, and an opposite second end connected electrically to said electrical plug, said electrical wire being retained in said first wire receiving groove that is formed in said back side of said stand; and a shade mounted removably on said top section of said stand to surround said lamp bulb of said lamp device; and a clock unit including:

a clock panel having a bottom end mounted removably on said top side of said base, and a front side which serves as a clock face and which is formed with an opening; and a clock hand mechanism having a housing retained in said opening, said clock hand mechanism cooperating with said clock face to indicate time.

2. The combined modular table lamp and clock assembly according to claim 1, wherein at least one of said base, said stand, said shade and said clock panel is formed from a flame-retardant foam material.

3. The combined modular table lamp and clock assembly according to claim 1, wherein said clock panel includes a plurality of interlocking panel pieces.

4. The combined modular table lamp and clock assembly according to claim 1, wherein said top side of said base is formed with a stand engaging groove for engaging said bottom section of said stand, and a clock panel engaging groove for engaging said bottom end of said clock panel.

5. The combined modular table lamp and clock assembly according to claim 4, wherein said clock panel engaging groove is disposed in front of said stand receiving groove.

6. The combined modular table lamp and clock assembly according to claim 4, wherein said stand engaging groove extends to said bottom side of said base, said electrical wire extending through said stand engaging groove in said base, said bottom side of said base being formed with a second wire receiving groove which extends between said stand engaging groove and a periphery of said base for receiving a portion of said electrical wire therein.

7. The combined modular table lamp and clock assembly according to claim 1, wherein said shade includes front and rear shading walls, and two bridging walls transverse to said front and rear shading walls to interconnect said front and rear shading walls, said front and rear shading walls and said bridging walls cooperatively confining a space for extension of said lamp bulb thereinto.

8. The combined modular table lamp and clock assembly according to claim 7, wherein each of said bridging walls has a bottom edge formed with a mounting groove for engaging said top section of said stand.

9. The combined modular table lamp and clock assembly according to claim 8, wherein said bottom edges of said bridging walls are raised relative to bottom edges of said front and rear shading walls.

* * * * *